US008319625B2

(12) United States Patent
Farley et al.

(10) Patent No.: US 8,319,625 B2
(45) Date of Patent: Nov. 27, 2012

(54) FIRE ALARM TEXTUAL NOTIFICATION RELATED APPLICATION

(75) Inventors: Daniel G. Farley, Westminster, MA (US); Jeffrey R. Brooks, Ashburnham, MA (US); Anthony J. Capowski, Westford, MA (US); John R. Haynes, Groton, MA (US); Gerald P. Gorman, Charlottesville, VA (US)

(73) Assignees: SimplexGrinnell LP, Westminster, MA (US); Inova Solutions, Charlottesville, VA (US)

( * ) Notice: Subject to any disclaimer, the term of this patent is extended or adjusted under 35 U.S.C. 154(b) by 640 days.

(21) Appl. No.: 11/514,612

(22) Filed: Sep. 1, 2006

(65) Prior Publication Data

US 2007/0046455 A1 Mar. 1, 2007

Related U.S. Application Data

(60) Provisional application No. 60/713,569, filed on Sep. 1, 2005.

(51) Int. Cl.
*G08B 29/00* (2006.01)

(52) U.S. Cl. ..... 340/506; 340/509; 340/525

(58) Field of Classification Search ..... 340/502, 340/506, 509, 524, 525, 531, 611, 614, 628, 340/629, 500, 574, 630; 370/37, 45; 704/270, 704/271; 359/484

See application file for complete search history.

(56) References Cited

U.S. PATENT DOCUMENTS

| | | | | |
|---|---|---|---|---|
| 6,553,100 | B1 * | 4/2003 | Chen et al. | 379/37 |
| 6,690,274 | B1 * | 2/2004 | Bristol | 340/506 |
| 6,867,688 | B2 * | 3/2005 | Lamb | 340/286.02 |
| 6,950,018 | B2 * | 9/2005 | Merrell et al. | 340/539.1 |
| 6,958,700 | B2 * | 10/2005 | Yoshida et al. | 340/691.3 |
| 6,987,448 | B2 * | 1/2006 | Catton et al. | 340/506 |
| 7,026,926 | B1 * | 4/2006 | Walker, III | 340/539.11 |
| 7,049,951 | B2 * | 5/2006 | Rhodes et al. | 340/500 |
| 7,319,853 | B2 * | 1/2008 | Luebke et al. | 455/344 |
| 7,339,467 | B2 * | 3/2008 | Lamb | 340/539.1 |
| 7,356,473 | B2 * | 4/2008 | Kates | 704/271 |
| 2002/0177428 | A1 * | 11/2002 | Menard et al. | 455/404 |
| 2004/0174597 | A1 * | 9/2004 | Craig et al. | 359/484 |
| 2005/0212677 | A1 * | 9/2005 | Byrne et al. | 340/574 |
| 2006/0154642 | A1 * | 7/2006 | Scannell, Jr. | 455/404.1 |
| 2007/0109114 | A1 * | 5/2007 | Farley et al. | 340/506 |

FOREIGN PATENT DOCUMENTS

JP 2003288371 A * 10/2003

* cited by examiner

*Primary Examiner* — Van T. Trieu

(74) *Attorney, Agent, or Firm* — The Small Patent Law Group LLP

(57) ABSTRACT

In accordance with the embodiments of the present invention, an alarm system is provided. The alarm system includes a system controller coupled to at least one initiation device. At least one textual notification device such as for example a signboard is coupled to the system controller. In one embodiment, the textual notification device is a multi-line signboard having an alarm input and a secondary input. The textual notification device is supervised, controlled, and powered integrally with the system controller. In an additional embodiment, an audible generator can be provided that provides an audible message in conjunction with the visual message on the textual notification devices.

39 Claims, 5 Drawing Sheets

FIRE ALARM TEXTUAL NOTIFICATION RELATED APPLICATION

RELATED APPLICATION

This application is related to U.S. Provisional Patent Application Ser. No. 60/713,569 titled "Fire Alarm Textual Notification Devices" filed on Sep. 1, 2005, the complete subject matter of which is incorporated by reference herein in its entirety.

BACKGROUND OF THE INVENTION

Embodiments of the present invention generally relate to methods and systems for providing fire alarms. Typical building fire alarm systems include a number of fire detectors positioned throughout a building. Signals from those detectors are monitored by a system controller, which, upon sensing an alarm condition, sounds audible alarms throughout the building. Flashing light strobes may also be positioned throughout the building to provide a visual alarm indication. The audible alarms and strobes are typically connected across common power lines on a notification circuit.

While in many situations such audible alarms and strobes operate sufficiently to notify an alarm condition, in other situations these alarms are insufficient. For example, the audible alarm can be difficult to hear in areas with high noise or poor acoustic properties. In addition, audible alarms cannot be used in areas requiring quiet, such as for example explosives areas. Still further, audible alarms are of limited usefulness in areas with populations that include the deaf and hard of hearing.

Textual notification devices are known. However, the use of textual notification devices requires building management to particularly create and direct such textual notification devices as to the message being transmitted. Thus, in an alarm condition these textual notification devices are of little use.

It would therefore be beneficial to offer an alarm system that provides an adequate notification of an alarm condition in areas wherein audible alarms are of limited use.

SUMMARY OF THE INVENTION

An alarm system in accordance with the embodiments of the present invention provides notification of an alarm condition in areas wherein audible alarms are of limited use. In accordance with the embodiments of the present invention, an alarm system is provided. The alarm system includes a system controller coupled to at least one initiation device. At least one textual notification device such as for example a signboard is coupled to the system controller. In one embodiment, the textual notification device is a multi-line signboard having an alarm input and a secondary input. The textual notification device is supervised, controlled, and powered integrally with the system controller. In an additional embodiment, an audible generator can be provided that provides an audible message in conjunction with the visual message on the textual notification devices.

BRIEF DESCRIPTION OF THE DRAWINGS

The foregoing and other objects, features, and advantages of the invention will be apparent from the following more particular description of preferred embodiments of the invention, as illustrated in the accompanying drawings. The drawings are not necessarily to scale, emphasis instead being placed upon illustrating the embodiments of the invention.

DETAILED DESCRIPTION OF THE PREFERRED EMBODIMENTS

In accordance with the embodiments of the present invention, an alarm system provides notification of an alarm condition in areas wherein audible alarms are of limited use. In one embodiment, the alarm system of the present invention can be incorporated into an alarm system as described in U.S. Pat. No. 6,426,697 titled "Alarm System Having Improved Communication" issued to Capowski, et al. on Jul. 30, 2002, the disclosure of which is incorporated by reference herein in its entirety.

Figure 1:
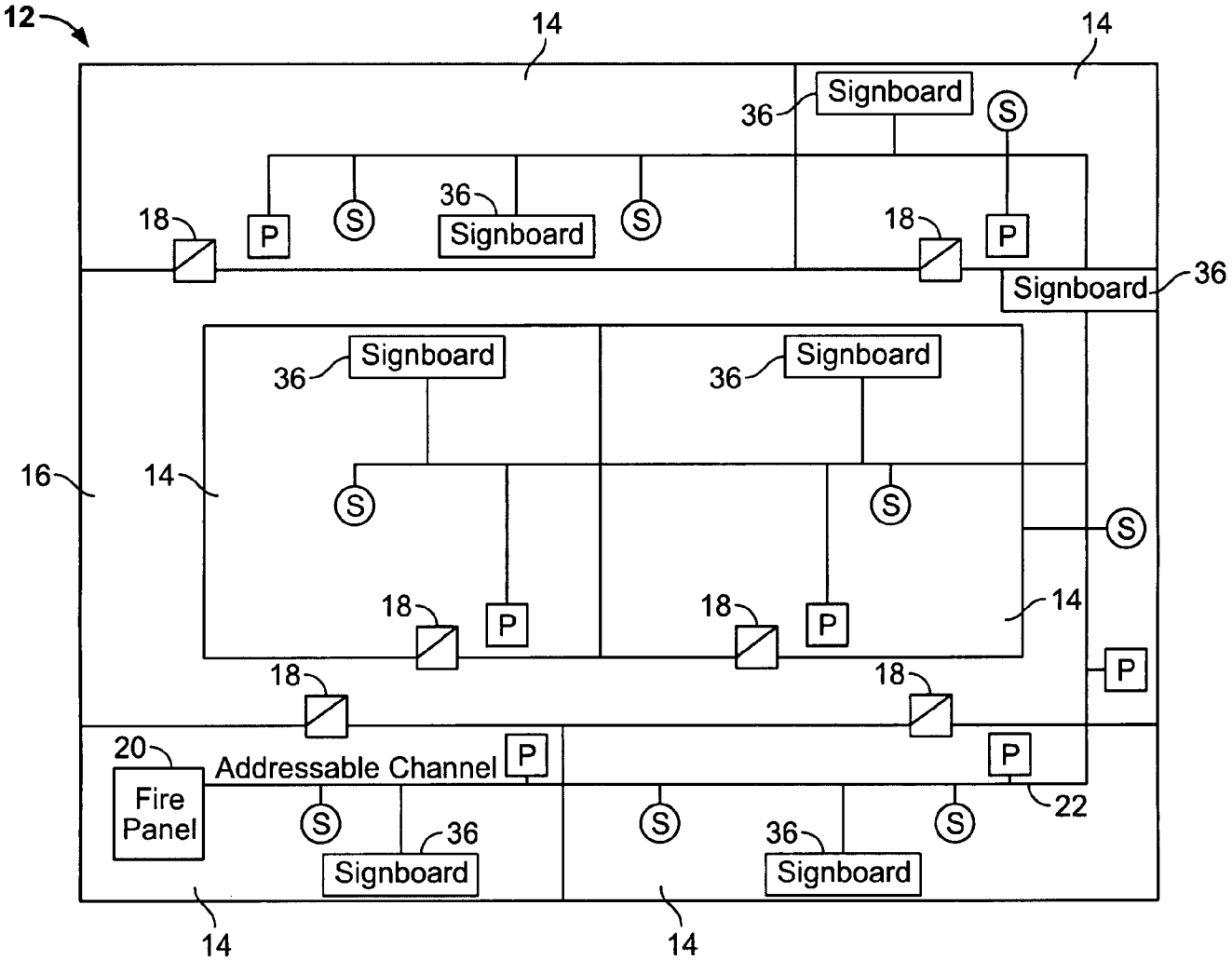
FIG. 1 is a schematic of an alarm system formed in accordance with an embodiment of the present invention.

Referring to FIG. 1, a schematic of an alarm system formed in accordance with an embodiment of the present invention is seen. The alarm system is displayed as on a floor 12 of a single or a multi-story building. The floor 12 includes a plurality of rooms 14. A hallway 16 allows ingress and egress to and from the rooms 14. Each room 14 is accessible from the hallway 16 by a door 18.

Figure 2:
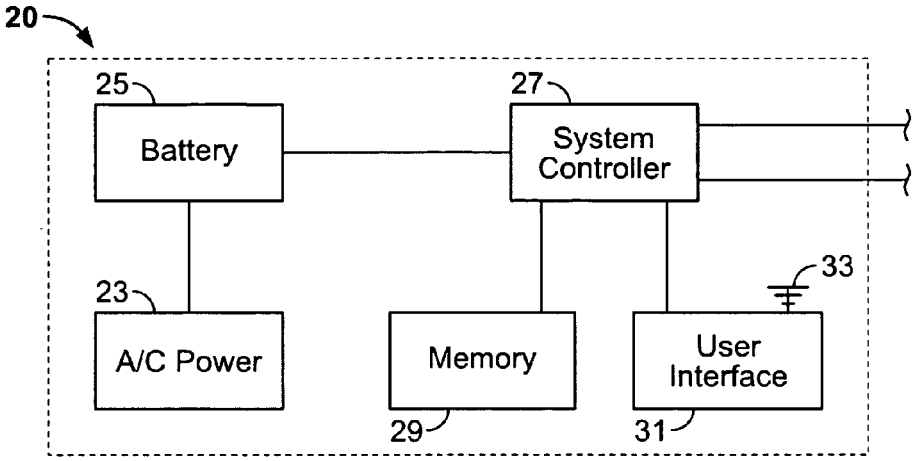
FIG. 2 is a block diagram of the fire panel of the alarm system of FIG. 1 formed in accordance with an embodiment of the present invention.

The alarm system includes a fire panel 20 coupled to a detector network 22. Referring to FIG. 2, a block diagram of the fire panel 20 is seen. The fire panel 20 provides system power such as a power source 23 and battery back-up 25, and a system controller 27 that provides system control and supervision. Other standard elements such as memory 29, a user interface 31, and a wireless or wired communications interface 33 can be further provided.

Referring back to FIG. 1, the detector network 22 can include an addressable channel that connects to a plurality of initiation devices such as smoke detectors (S) and pull stations (P). Preferably in fire detection practice, each room 14 and the hallway 16 should include at least one such initiation device. In one embodiment, standard notification devices such as audible alarms and light strobe alarms can be provided connected in the detector network 22. When an alarm condition is sensed, the system controller 27 of the fire panel 20 signals an alarm to the appropriate devices through the detector network 22.

In accordance with the embodiments of the present invention, at least one textual notification device 36 is provided in the detector network 22 integral to the alarm system. As with the initiation devices, each room 14 and the hallway 16 should preferably include at least one textual notification device 36. Alarm messages are activated from the alarm system via the system controller 27 of the fire panel 20. The textual notification device 36 is supervised via an addressable loop that is also connected to other initiating and/or notification devices installed in the network. By providing system supervision via the system controller 27, the present invention periodically communicates to the textual notification devices 36 even when the system is idle. If a component of a textual notification device 36 fails, or if a textual notification device 36 stops responding to the communications, a trouble condition is indicated on the fire panel 20 so the user is made aware and can make appropriate repairs.

In accordance with the embodiments of the present invention, the textual notification devices 36 are connected to the addressable channel on the fire panel 20, and are controlled and supervised via that addressable channel and also powered by the fire panel 20. The textual notification devices 36 are supervised, controlled, and powered directly from the fire panel 20 so the textual notification devices 36 are an integral part of the alarm system which is already designed to be a survivable entity. The textual notification devices 36 are powered by the alarm system so textual notification devices 36 are battery backed.

Figure 3:
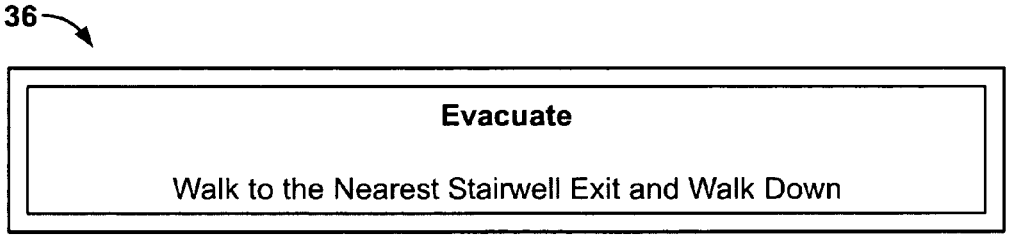
FIG. 3 is a detailed view of an example signboard of the alarm system of FIG. 1.

In one embodiment, the textual notification device can be a signboard. Referring now to FIG. 3, in one embodiment of the present invention the textual notification device can be a multi-line signboard 36. With a multi-line signboard 36, a first line may be constant for a given alarm condition and provide a brief instructional message informing the building occupant of what action is necessary. Examples of such brief instructional message can include "Shelter in Place", "Standby for Further Instructions" or, as provided in FIG. 3, "Evacuate". The brief instructional message can be adapted to display different messages depending on the event coming into the alarm system.

Additional lines in a multi-line signboard 36 can scroll additional details about the alarm state. An example of such scrolled instructional message can include "Do not use the elevators! Walk to the nearest stairwell exit and walk down to street level and exit the building"; because this is a scrolling message, the additional line depicted in FIG. 3 shows only a portion of the scrolling message as follows (with that portion of the message either previously scrolled or yet to be displayed bracketed): "[Do not use the elevators. Walk to the nearest stairwell exit and walk down to street level and exit the building]". The scrolled instructional message can be adapted to display different messages depending on the event coming into the alarm system.

Figure 4:
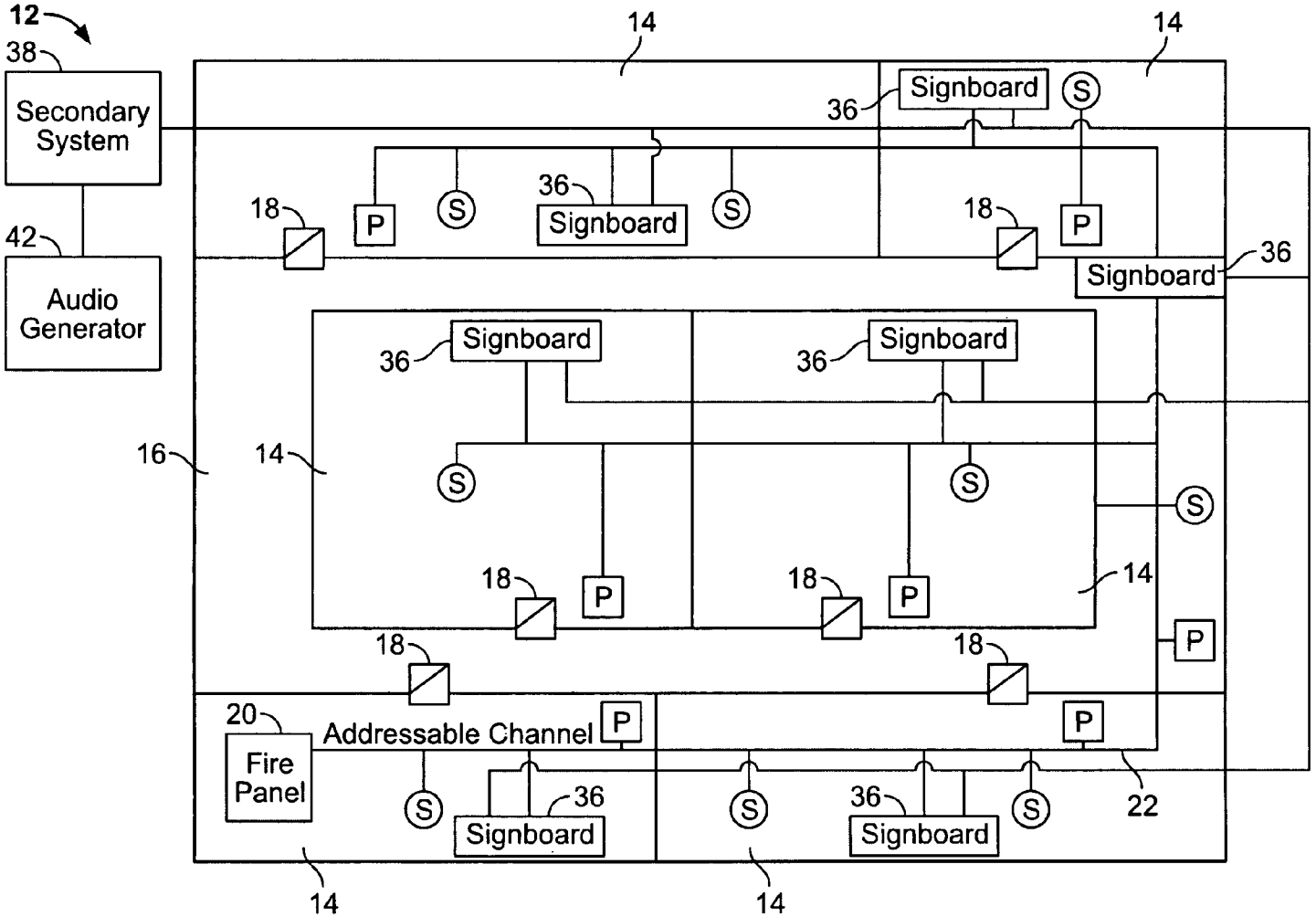
FIG. 4 is a schematic view of an alarm system in accordance with an alternative embodiment of the present invention.

In addition to having the addressable channel input, in one embodiment the textual notification devices 36 can have a secondary input so the textual notification devices 36 can be used to display secondary information. This secondary information could be for general purpose notification of non-alarm condition events or information. Such secondary information can include for example information about upcoming events at the facility (for example, at a school), commercial information (for example, at a store or shopping mall); general information such as the weather, etc. Referring to FIG. 4, a schematic view of an alarm system in accordance with this alternative embodiment of the present invention is seen. In FIG. 4, like elements contain like reference numerals to FIG. 1; thus, the alarm system is displayed as on a floor 12 that includes a plurality of rooms 14, a hallway 16, and doors 18. The alarm system includes a fire panel 20 that provides system power, system control and system supervision.

In this embodiment, a separate feed from a secondary system 38 provides a secondary input to the textual notification devices 36. Thus, the textual notification devices 36 are provided with two inputs: one from the fire panel 20; and a separate feed from the secondary system 38 that provides secondary information. Secondary information will be displayed on the textual notification devices 36 as long as there is no message being activated from the fire panel 20. if any message is activated from the fire panel 2 such alarm messages will take priority over the secondary information received from the secondary system 38.

Figure 5:
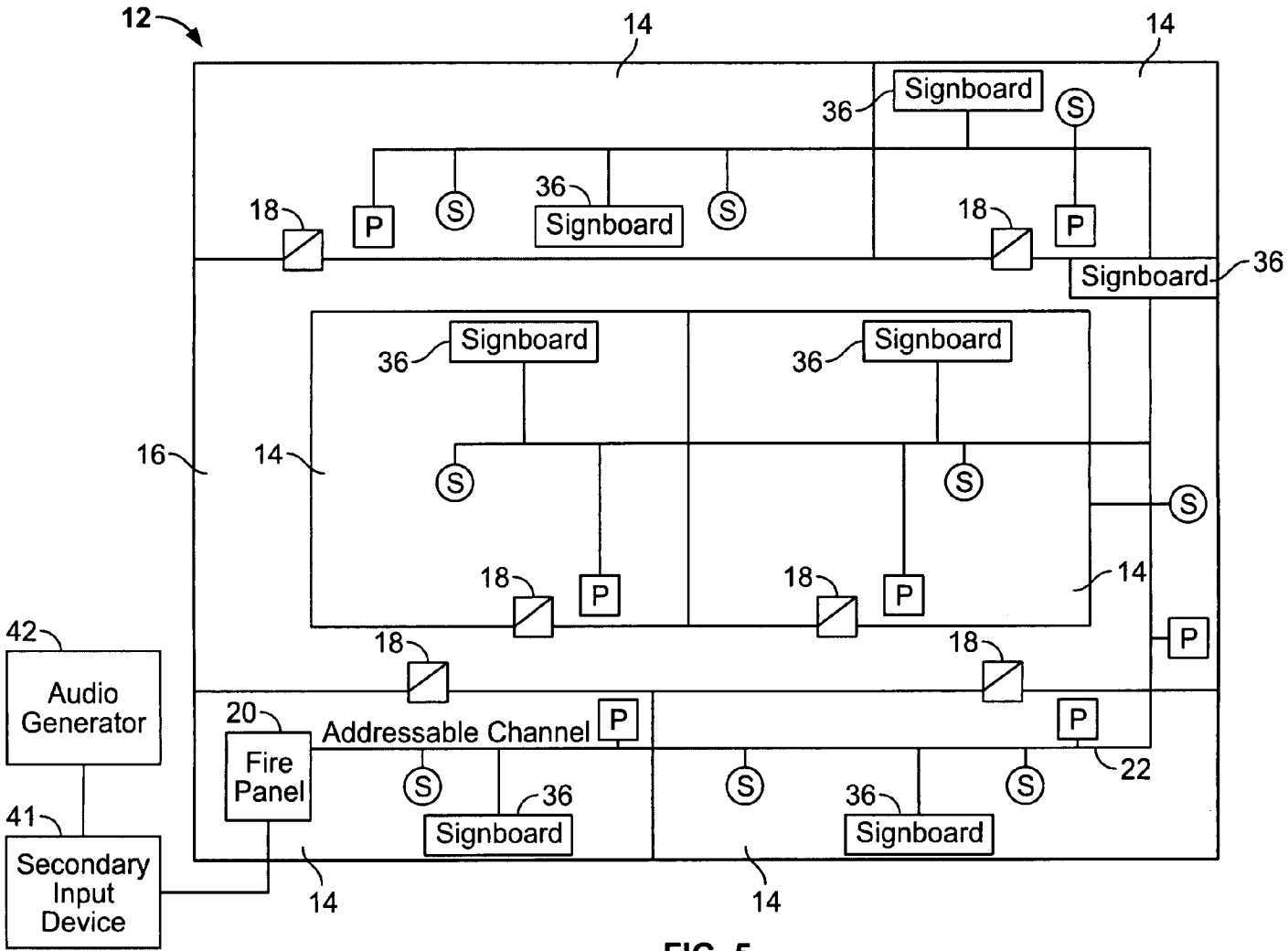
FIG. 5 is a schematic view of another embodiment of the alarm system of FIG. 4.

Referring to FIG. 5, a schematic view of an additional embodiment providing secondary input to the textual notification devices 36 is seen. Again, in FIG. 5 like elements contain like reference numeral to FIG. 1. In this embodiment, a secondary input device 41 is provided that provides to the fire panel 20 the secondary information. When secondary input is provided, the system controller 27 of the fire panel 20 provides the secondary message to the textual notification device 36 through the detector network 22. Again, an alarm condition input on the textual notification device 36 is a higher input so that alarm messages always override secondary information.

Figure 6:
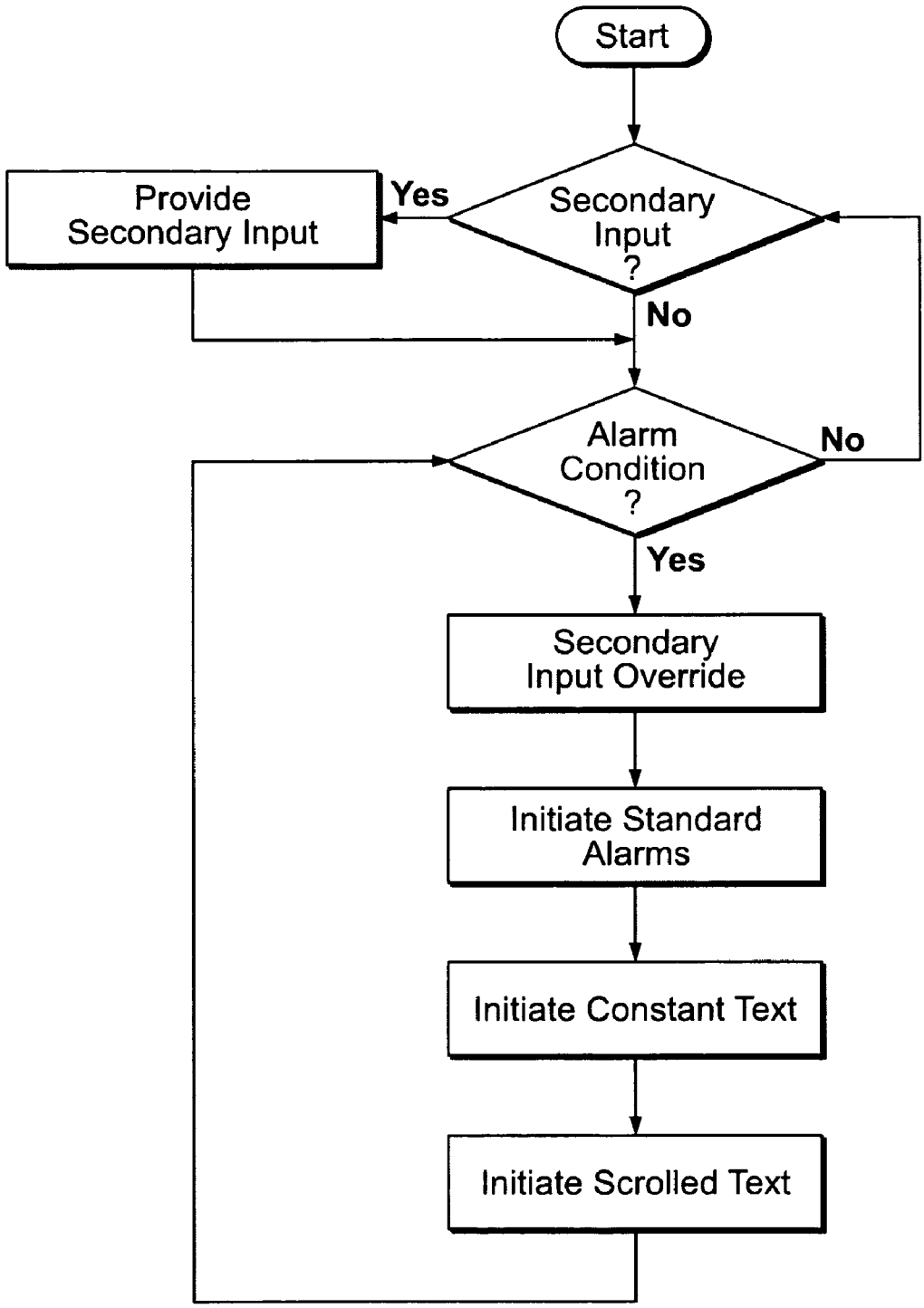
FIG. 6 is a process flow diagram of the alarm system of FIG. 5.

Referring to FIG. 6, a process flow diagram of the alarm system of FIG. 5 is seen. Initially, the existence of a secondary input is checked. If there is a secondary input, then the system controller 27 of the fire panel 20 provides the secondary message to the textual notification device 36 through the detector network 22. The system is constantly monitoring for the existence of an alarm condition. If an alarm condition is initiated from an initiation device such as a smoke detector (S) or a pull station (P), then the secondary input is overridden, and a standard alarm such as audible alarms and light strobe alarms are initiated to the respective devices, the constant text message is provided to textual notification device 36, and the scrolling text message is provided to textual notification device 36. The process loops back to the alarm condition inquiry. Once again, if an alarm condition continues to be present, then the secondary input continues to be overridden, and the alarms are provided to the respective devices. If an alarm condition is no longer present, then the process returns to the secondary input inquiry.

While it is an advantage that an alarm system of the present invention provides notification of an alarm condition in areas wherein audible alarms are of limited use, in a further embodiment of the present invention an audible message can be provided in conjunction with the visual message on the textual notification devices 36 for those not hearing impaired or where high noise is transient. To provide an audible message in conjunction with the visual message on the textual notification devices 36, an audio generator 42 as seen in FIGS. 4 and 5 is provided. In one embodiment, the audio generator 42 can comprise a text-to-speech converter as known that converts the textual messages into an audible message for broadcast on speakers provided with the textual notification devices 36. In another embodiment, the audio generator 42 can comprise a speech-to-text converter as known that converts audible messages into textual message such as for example audio messages broadcast on a public address system. The textual messages can be feed into the textual notification devices 36 as previously described.

While this invention has been particularly shown and described with references to preferred embodiments thereof, it will be understood by those skilled in the art that various changes in form and details may be made therein without departing from the scope of the invention encompassed by the appended claims.

What is claimed is:

1. A fire alarm system comprising:

a system controller;

at least one initiation device coupled to the system controller; and at least one textual notification device located remotely from and coupled to the system controller, the at least one textual notification device integral to the fire alarm system, wherein the textual notification device comprises a first input receiving alarm information from the system controller and a different second input receiving non-alarm information from a secondary system, the textual notification device adapted to override a display of the non-alarm information received from the second input when the alarm information is received from the first input.

2. The fire alarm system of claim 1 wherein the at least one initiation device is selected from the group comprising smoke detectors, pull stations, and combinations thereof.

3. The fire alarm system of claim 1 wherein the alarm system further comprises any of audible alarms, light strobe alarms, and combination thereof coupled to the system controller.

4. The fire alarm system of claim 1 wherein the at least one textual notification device is supervised, controlled, and powered directly from the system controller.

5. The fire alarm system of claim 1 wherein the at least one textual notification device comprises a signboard.

6. The fire alarm system of claim 5 wherein the signboard comprises a multi-line signboard.

7. The fire alarm system of claim 6 wherein the multi-line signboard comprises a line providing at least one of a constant message and a scrolling message.

8. The fire alarm system of claim 1 further comprising an audible generator that utilizes the alarm information to generate an audible message for broadcast in conjunction with the alarm information being displayed by the textual notification device.

9. A fire alarm system in accordance with claim 1 wherein the system controller is configured to periodically communicate with the at least one textual notification device and based on the periodic communication determine the operational state of the textual notification device.

10. A fire alarm system in accordance with claim 1 wherein the system controller is configured to periodically communicate with the at least one textual notification device and display an indication when the textual notification device fails to respond to the periodic communication.

11. A fire alarm system in accordance with claim 1 wherein the fire alarm system further comprises an addressable communication loop coupled between the system controller, the at least one textual notification device, and at least one initiation device, the addressable communication loop configured to enable the system controller to supervise and control the textual notification device.

12. A fire alarm system in accordance with claim 1 wherein the textual notification device has an address that is different than an address of the fire alarm system controller.

13. A fire alarm system in accordance with claim 1 wherein the fire alarm system further comprises an addressable loop, the system controller, the textual notification device, and the at least one initiation device being coupled to the addressable loop, the system controller being configured address the system controller, the textual notification device, and the at least one initiation device via the addressable loop.

14. A method of providing an alarm comprising:

providing a fire system controller;

coupling at least one initiation device to the fire system controller;

locating at least one textual notification device at a location that is remote from the fire system controller, wherein the textual notification device comprises a first input receiving alarm information from the fire system controller and a different second input receiving non-alarm information from a secondary system, the textual notification device adapted to override a display of the non-alarm information received from the second input when the alarm information is received from the first input;

coupling the at least one textual notification device to the fire system controller; and integrally controlling the at least one textual notification device using the fire system controller.

15. The method of providing an alarm of claim 14 further including providing at least one initiation device selected from the group comprising smoke detectors, pull stations, and combinations thereof.

16. The method of providing an alarm of claim 14 further including providing any of audible alarms, light strobe alarms, and combinations thereof.

17. The method of providing an alarm of claim 14 further including supervising, controlling, and powering the at least one textual notification device directly from the fire system controller.

18. The method of providing an alarm of claim 14 further including coupling at least one signboard to the fire system controller.

19. The method of providing an alarm of claim 18 further including coupling at least one multi-line signboard to the fire system controller.

20. The method of providing an alarm of claim 19 further including establishing at least one of a constant message and a scrolling message on the multi-line signboard.

21. The method of providing an alarm of claim 14 further including providing an audible message in conjunction with the textual notification device.

22. An alarm system comprising:

a fire system controller;

at least one initiation device coupled to the fire system controller; and at least one multi-line textual notification device located remotely from the fire system controller and coupled to the fire system controller, the multi-line textual notification device having an alarm input for receiving alarm information and a secondary input for receiving non-alarm information, the textual notification device adapted to override a display of the non-alarm information received from the secondary input when alarm information is received from the first input.

23. The alarm system of claim 22 wherein the at least one initiation device is selected from the group comprising smoke detectors, pull stations, and combinations thereof.

24. The alarm system of claim 22 wherein the alarm system further comprises any of audible alarms, light strobe alarms, and combinations thereof coupled to the fire system controller.

25. The alarm system of claim 22 wherein the multi-line textual notification device is supervised, controlled, and powered integrally with the fire system controller.

26. The alarm system of claim 22 wherein the multi-line textual notification device comprises a line providing at least one of a constant message and a scrolling message.

27. The alarm system of claim 22 further comprising an audible generator that provides an audible message in conjunction with the multi-line textual notification device.

28. An alarm system comprising:

a fire alarm panel;

a fire system controller located in the fire alarm panel;

at least one initiation device coupled to the fire system controller;

at least one textual notification device located remotely from the fire system controller and coupled to the fire system controller to provide a visual message; and an audible generator that utilizes the visual message to generate an audible message that is broadcast in conjunction with the visual message provided on the textual notification devices.

29. The alarm system of claim 28 wherein the at least one initiation device is selected from the group comprising smoke detectors, pull stations, and combinations thereof.

30. The alarm system of claim 28 wherein the alarm system further comprises any of audible alarms, light strobe alarms, and combinations thereof coupled to the fire system controller.

31. The alarm system of claim 28 wherein the textual notification device is supervised, controlled, and powered directly from the fire system controller.

32. The alarm system of claim 28 wherein the at least one textual notification device comprises a signboard.

33. The alarm system of claim 32 wherein the signboard comprises a multi-line signboard.

34. The alarm system of claim 33 wherein the multi-line signboard comprises a line providing at least one of a constant message and a scrolling message.

35. The alarm system of claim 28 wherein the audible generator comprises a text-to-speech converter.

36. The alarm system of claim 28 wherein the audible generator comprises a speech-to-text converter.

37. A textual notification device for a fire alarm system; said textual notification device comprising:

a first input coupled to a fire alarm panel; and a second input coupled to a secondary system, the textual notification device configured to display alarm information received from the first input and display non-alarm information received at the second input, the textual notification device configured to override a display of the non-alarm information received from the second input when the alarm information is received from the first input.

38. A textual notification device in accordance with claim 37 wherein the textual notification device is configured to receive power directly from the fire system controller.

39. A textual notification device in accordance with claim 37 wherein the textual notification device is coupled to an addressable communication loop to enable the fire alarm panel to address the textual notification device and at least one initiation device via the addressable loop.

* * * * *